US012584261B2

(12) United States Patent
Torun et al.

(10) Patent No.: US 12,584,261 B2
(45) Date of Patent: Mar. 24, 2026

(54) DEVICE FOR ACTIVATING A MEDIATOR SPECIES

(71) Applicant: Henkel AG & Co. KGaA, Duesseldorf (DE)

(72) Inventors: Boray Torun, Duesseldorf (DE); Peter Schmiedel, Duesseldorf (DE); Robert Ciupka, Langenfeld (DE); Sandra Treu, Duesseldorf (DE); Isabel Kinscheck, Haan (DE); Komalshree Muthukrishnan, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 839 days.

(21) Appl. No.: 17/313,261

(22) Filed: May 6, 2021

(65) Prior Publication Data

US 2021/0254257 A1 Aug. 19, 2021

Related U.S. Application Data

(63) Continuation of application No. PCT/EP2019/077632, filed on Oct. 11, 2019.

(30) Foreign Application Priority Data

Nov. 6, 2018 (DE) ..... 102018218878.5

(51) Int. Cl.

| | |
|---|---|
| ***D06F 35/00*** | (2006.01) |
| ***C25B 3/23*** | (2021.01) |
| ***C25B 11/02*** | (2021.01) |
| ***D06F 39/02*** | (2006.01) |

(52) U.S. Cl.

CPC ..... *D06F 35/003* (2013.01); *C25B 3/23* (2021.01); *C25B 11/02* (2013.01); *D06F 39/024* (2013.01)

(58) Field of Classification Search

CPC ..... D06F 35/003

See application file for complete search history.

(56) References Cited

U.S. PATENT DOCUMENTS

| | | | | |
|---|---|---|---|---|
| 4,319,973 | A * | 3/1982 | Porta | D06F 35/003 8/111 |
| 2003/0213704 | A1* | 11/2003 | Scheper | A47L 15/4238 204/229.4 |
| 2015/0151985 | A1* | 6/2015 | Johnson | C02F 1/463 204/272 |
| 2015/0259222 | A1* | 9/2015 | Smith | C02F 1/46104 205/742 |
| 2020/0390802 | A1* | 12/2020 | Cinquin | A61N 1/05 |

FOREIGN PATENT DOCUMENTS

| | | | |
|---|---|---|---|
| DE | 102008035910 | A1 | 2/2010 |
| DE | 102014213312 | A1 | 1/2016 |
| DE | 102014220623 | A1 | 4/2016 |
| JP | 2004298754 | A | 10/2004 |
| WO | 2015162008 | A1 | 10/2015 |

OTHER PUBLICATIONS

PCT International Search Report PCT/EP2019/077632 Completed: Dec. 3, 2019; Mail Date: Dec. 11, 2019 3 pages.

* cited by examiner

*Primary Examiner* — Ciel P Contreras
(74) *Attorney, Agent, or Firm* — Bojuan Deng

(57) ABSTRACT

The invention relates to a device for activating a mediator species by way of electrolysis, including a voltage source and an anode connected to the voltage source and a cathode connected to the voltage source, the anode being enclosed in a liquid-permeable, electrically non-conductive sheath.

20 Claims, 1 Drawing Sheet

DEVICE FOR ACTIVATING A MEDIATOR SPECIES

FIELD OF THE INVENTION

The present invention relates to a device for activating a mediator species into a bleach-active species by way of electrolysis, comprising a voltage source and an anode connected to the voltage source and a cathode connected to the voltage source.

In this context, mediator species is understood to mean a substance which is bleach-active in the activated or oxidized state. It is also referred to as a bleach-active species.

BACKGROUND OF THE INVENTION

The invention relates to the field of washing machine technology, in particular in the domain of household washing machines. It is primarily related to the well-known problem that much everyday soiling is only insufficiently removed when using liquid washing agent. Categories of this soiling include, for example, anthocyanin-containing dyes or dyes from the group of carotenoids.

The background to this problem is that the removal of certain stains is largely based on an oxidation reaction of a chromophore. By the oxidation of a delocalized π-electron system, the dye loses the property of absorbing light in the visual spectral range and appears colorless. In addition, in some cases the dye can break down into smaller and more water-soluble species. However, bleach systems typically used in solid washing agents (e.g., TAED+sodium percarbonate) require comparatively high temperatures in order to develop their full effect. The development of a liquid washing agent for use in households with a potent bleaching effect is also made more difficult by the incompatibility of the bleach, in particular with the enzymes contained in the washing agent.

It is known in the prior art that an electrochemically mediated bleaching reaction can solve both problems (high temperature, incompatibility in the liquid product). The principle of this bleaching process can be seen in the transfer of an oxidation reaction on an anode surface of an electrochemical cell to the textile to be bleached. Presumably, a mediator molecule initially present in reduced form is oxidized at the anode of the electrochemical cell. This oxidized, or activated, mediator species can in turn oxidize a dye molecule, is thus bleach-active and is itself returned to the reduced species, which is available for renewed oxidation (activation). In this way, it is possible to produce a bleaching effect with a comparatively small amount of mediator, since, in contrast to a traditional system, it is not necessary to select a stoichiometric use amount for the substrate to be bleached. In addition, the mediator molecule is only able to oxidize substrates in conjunction with an electrochemical cell.

For this reason, no unwanted reaction to oxidation-sensitive components contained in the washing agent, such as the enzymes, is to be expected. In addition, compared to a traditional bleaching system such as TAED+sodium percarbonate, there is no need to increase the washing temperature to allow the electrochemical process to take place.

EP3134500A1 discloses the use of particular organic mediator compounds to enhance the cleaning performance of washing and cleaning agents against soiling, washing or cleaning processes using bleach-active species produced from such mediator compounds, and washing and cleaning agents which contain the mediator compound.

It is therefore the object of the present invention to provide a device which allows a mediator species to be activated into a bleach-active form.

BRIEF SUMMARY OF THE INVENTION

The object is achieved by a device for activating a mediator species by way of electrolysis and by using the device for activating a mediator species during a washing process in the washing drum of a washing machine, and by inserting the device into the washing drum, such that the device comes into contact with washing liquor during operation of the washing machine. The appended claims further describe advantageous developments of the invention.

In particular, the invention makes it possible for an electrochemical washing process to be implemented that is compatible with commercially available washing machines. In particular, several major problems are solved in the context of apparatus implementation: Due to the voltage unit, the device according to the invention, as an autonomous system, is compatible with all commercially available washing machines since no separate interface has to be provided. In addition, due to the insulating sheath, the device is protected against electrical effects—in the form of a short circuit—and at the same time mechanical effects of the laundry drum, and can therefore be used non-destructively, i.e., in particular, repeatedly. At the same time, sufficient contact between the effective surfaces of the electrodes and the washing liquor equipped with the electrochemical mediator is ensured. The structure of the sheath is therefore preferably selected such that the two electrodes cannot establish direct (anode touches cathode) or indirect (anode and/or cathode touch an electrically conductive object inside the washing machine) electrical contact or a short circuit.

Since the device carries an independent voltage source, i.e., a power supply, it functions independently and is therefore compatible with commercially available washing machines. In addition, no adaptation or other modification of the washing machine is required for the intended use.

Furthermore, by means of the deformable sheath it is possible to create a device which has a pillow-like geometry. This makes the device easy to grip and handle. Likewise, a pillow-like aesthetic or look is familiar to the consumer from everyday life, in particular in the context of laundry, and thus ensures a low inhibition threshold for use.

Voltage Source

The voltage source has an energy store, for example a battery, and is used to apply the potential required for the electrochemical reaction to the anode and the cathode. The amount of the potential difference between the electrodes is up to 10 V or 5 V, preferably 0.5 to 4.5 V, very preferably 1.5 to 3.5 V. The polarization can be freely selected. The voltage source is preferably designed such that it can provide the current strength required for the selected potential. The energy store can be rechargeable, it being possible to charge the energy store, for example, by the following methods: Removing the energy store, for example a battery, from the voltage supply and charging it in a separate external apparatus, or connecting the device or the voltage supply to an external charging apparatus. In all of the methods, charging can be carried out in a wired manner or, for example, via inductive power transmission. Other charging techniques known to a person skilled in the art are also conceivable. The voltage source can have a regulator via which, for example, the voltage is regulated, for example once or also, for example, according to parameters that can be stored in a memory unit, determined by sensors or received by a communication unit.

Anode

The mediator is activated by oxidation on the anode surface. Possible embodiments for the anode are, for example

- planar shapes such as sheets,
- shaped bodies based on machining or non-machining shaping,
- thin layers that are applied to a substrate, for example by evaporation or plasma deposition,
- woolly or wool-like structures,
- spongy structures, or
- electrodes of a textile nature such as woven or non-woven knitted fabrics.

An essential requirement for the selection of the material is electrical conductivity within the material that is sufficient for the process and an effective area, i.e., exchange area with the washing solution, that is as large as possible. An anode having a high quotient of effective surface to volume or structural volume is therefore preferred. Known methods for surface treatment (for example roughening, grinding, etching or pickling) can be used to enlarge the exchange area with the washing solution. It is also conceivable to manufacture an anode by sintering.

Cathode

The cathode can comprise or consist of a material that is identical to or different from the anode. The size, the volume, the area of the surface and the mass of the cathode can differ from the relevant value of the anode or be identical. The main task of the cathode is to provide sufficient counterreaction to the electrochemical activation reaction at the anode. The cathode is preferably designed substantially similarly or identically to the anode, in particular with regard to the geometric and mechanical properties. The cathode and the anode must not touch each other even under mechanical stress, or in any case under mechanical damage to the device, and this can be achieved, for example, by their arrangement and geometry (for example as two pillows at opposite ends of an insulating housing of the power supply) or via the at least one sheath (for example, a separate sheath per electrode, or a common sheath narrowed in an intermediate region).

Sheath

The sheath insulates the anode and the cathode from an electrical short circuit by direct contact with one another and also with external objects. In addition, said sheath is used to mechanically protect both the device and the washing machine, including their contents, and as a grip element for a user. For example, a sheath is provided for the anode and the cathode, which sheath has a non-electrically conductive material at least on the relevant outer side such that no electrical contact occurs when there is external mechanical contact. The sheath preferably consists entirely of an electrically non-conductive material. In addition, the sheath is permeable to liquids, in particular to water-rich solutions, for example washing liquor and the substances contained therein such as a mediator compound.

The sheath can be divided into a plurality of portions or compartments which each enclose individual components of the device, for example anode, cathode and voltage source, separately from one another. The sheath can consist of a spongy material or contain a spongy intermediate layer which can absorb a certain amount of washing liquor. The sheath can have an opening that is preferably closable, for example using a zip fastener, hook and loop fastener, magnetic fastener or snap fastener, for maintenance or for wired charging of the voltage supply necessary for operation. The sheath can consist of a liquid-permeable film.

The sheath can comprise or consist of natural or synthetic material, for example a textile or plastics material. The sheath can be made of fibers, which fibers can be combined to form a woven or non-woven knitted fabric.

According to a preferred improvement of the invention, the sheath is deformable. Deformable is understood to mean that the sheath can adapt its shape to an external geometry elastically or inelastically, and in any case non-destructively and reversibly, by the action of a mechanical force. Preferably, a force of which the amount is less than the weight of the sheath is already sufficient to deform the sheath. When the empty sheath rests on a surface, it at least partially adopts the geometry of said surface. This causes better handling and better mobility, as well as damping of impacts in the washing drum, which effectively prevents mechanical damage.

The invention is further improved in that the sheath is in the form of a, preferably woven, net. Net is understood to mean that the sheath is made up of meshes, the open spaces of the meshes creating the liquid permeability and the material of the meshes creating the electrical insulation against a short circuit by direct contact. If the sheath is woven, it can absorb liquid by capillary action and release the liquid again when it is deformed, in particular when it is compressed, which increases the throughput of mediator liquid.

In a preferred embodiment of the invention, the sheath encloses the entire device. Thus, not only are the electrodes protected from short circuits but also the power supply or its housing is protected from mechanical action such as impacts and friction.

The voltage source particularly preferably has a housing to which the sheath is fastened. In particular, if the cathode and the anode are arranged on two opposite sides of the voltage source, electrical insulation between the electrodes is thus ensured at the same time. The fastening can be detachable, for example by means of a form fit or by means of a fastening element such as a button, or non-detachable, for example glued. Alternatively or additionally, the sleeve can also be attached to one or both electrodes.

Very particularly preferably at least half, preferably at least 90% of the area of the effective surface of the anode is enclosed by the anode. This is equivalent to the fact that the majority of the effective surface of the anode is located inside said anode. This makes it possible to provide an anode which is compact in terms of volume and has a large effective surface. Especially in a washing machine, in which both the available volume and the amount of mediator material are limited, the effectiveness of the device is thereby improved.

In a preferred variant, the anode has a plurality of channels. Channels are understood to mean passages or tunnels which lead from one point on an outer surface of the anode through the inside to another point on the outer surface on the anode. These channels can be branched or forked as required. This simultaneously provides a large area of the surface of the anode and ensures that this surface is galvanically interconnected everywhere, i.e., that substantially the same potential is applied everywhere in the anode.

The anode is very particularly preferably deformable, preferably with a variable volume, i.e., such that stretching and compression can occur along an axis. This has several advantages. By adapting the shape of the anode to external geometries, damage to both the anode and the washing drum is avoided. In particular, if a large part of the effective area of the surface of the anode is arranged within said anode, deformation of the anode also brings about a pumping effect, since deformation of the anode is accompanied by deformation and a change in volume of the spaces in the surface. If, for example, the anode is compressed, then liquid is forced out of the inside of said anode, it being possible for this liquid to already have at least partially come into contact with the anode, i.e., the liquid tends to contain oxidized or activated mediators. When the anode is stretched, liquid is sucked inside, where reduced mediators can then be activated. The deformability thus improves the convection through the anode.

The invention is then further improved in that the anode is elastically deformable. This prevents the anode from only compressing, which could optionally be possible in particular in a washing drum due to the centrifugal forces and impact forces through the walls of the drum and its contents.

It is further preferred that substantially every first point on the surface of the anode is either exposed or rests against a second point on the surface of the anode, which second point is movable relative to the first point. As a result, in particular in the case of a deformable anode, the anode rubs against itself inside thereof when it is deformed, which likewise increases the convection and the throughput of mediators over the anode surface.

The anode is very particularly preferably made from a group of materials, which group comprises steel wool, an electrically conductive textile and chips.

A metallic wool-like structure is preferably selected as the electrode material for both the anode and the cathode. Due to the high ratio of surface to volume, this selection results in a particularly large exchange area with the washing liquor in relation to the mass of material used. Tests showed that an ideal surface/volume ratio is between $2.5\times10^3$ $m^2/m^3$ and $2.5\times10^7$ $m^2/m^3$, preferably between $2.5\times10^4$ $m^2/m^3$ and $2.5\times10^6$ $m^2/m^3$, and very particularly preferably between $2.5\times10^5$ $m^2/m^3$ and $4\times10^5$ $m^2/m^3$. In this context, the term surface is understood to mean the macroscopic surface, without taking into account surface structures such as roughness. This selection of material makes it possible to optimize the amount of material used to such an extent that there are no significant imbalances in a spin phase of a washing process.

It was also found that a flexible, wool-like electrode material surprisingly has a disproportional effect on the efficiency of the device according to the invention. Without being tied to a theory, this observation can be explained by the continuous "milling" of the flexible anode during a wash cycle. This results in a forced and recurring exchange of washing solution through compression phases (washing liquor is pressed out) and expansion phases (washing liquor is absorbed into the wool-like electrodes), as a result of which an activated mediator species leaves the anode and a deactivated species enters the anode. This ensures sufficient convection of the activated mediator into the wash liquor and of the deactivated mediator to the anode.

Furthermore, particularly preferably, the voltage source is protected from contact with external planes in all spatial directions by padding. Padding is understood to mean a unit for mechanical damping, for example in the form of a pillow. In particular, the voltage source is housed in a housing which is protected from impacts against the washing drum by the padding. By cleverly arranging the other internal assemblies, it is also possible to design the device in such a way that the assemblies having a hard housing (for example the power supply) are enveloped by the flexible assemblies (for example the sheath, the anode and/or cathode) and are protected from impacts and blows. This results in both a particularly low acoustic load during use and a low mechanical load on the textiles to be cleaned.

Very particularly preferably, the padding comprises the anode, or both electrodes, and the sheath. Thus, the deformability and optionally elasticity of the anode, or both electrodes, is used not only to optimize the activation of the mediator, but also at the same time synergistically for the mechanical protection of the device, in particular the voltage supply, for example. Additional padding is not excluded, for example between the sheath and power supply, for example in the form of a textile layer or a foam. It is also conceivable that the anode and/or cathode completely enclose the voltage source.

In a further improvement of the invention, the device has a generator. This preferably electrical generator should be suitable for "energy harvesting," for example taking kinetic energy from the rotational movement of the washing drum and/or from its contents and converting it into electrical energy, in order to operate the device and/or charge the energy store. For example, the generator can, by means of a pendulum, a flywheel or a turbine, absorb or pick up the energy to be dissipated.

The device further preferably has a sensor for measuring conductivity, temperature, acceleration, pH or sound. The operation of the device can thus be coupled to the operation of the washing machine. For example, the start and/or the end and/or characteristic events (for example a heating phase, a rinse cycle, an addition of washing agent) of a washing cycle can be detected. Particularly preferably, the device can then be automatically activated and/or deactivated and/or controlled, for example by regulating the voltage between the electrodes. In addition, the device can be equipped with communication means that make it possible to read out and/or influence operating parameters or control information or control commands of the washing machine or another communication unit, such as a mobile telephone, at any time. Various communication means can be used for this purpose, for example to implement optical communication (for example infrared), acoustic communication, or communication via radio, such as Wi-Fi, Bluetooth, ZigBee or Z-Wave.

Detailed tests of a device according to the invention were carried out in a commercially available washing machine (Siemens 14T7G1).

In a test V1, a device according to the invention that was switched on and a wash load together with test stains were supplied to the washing machine in order to evaluate the cleaning effect on bleachable soiling. The washing machine was then filled with a washing liquor containing, inter alia, an electrochemical mediator according to EP 3134500 A1, and a washing program was started. After the washing cycle was completed, the test stains were removed, dried and evaluated using a photospectroscopic method. To quantify the cleaning effect, the ΔY value between the unwashed stain and the washed stain was used in each case.

As a reference experiment R1, a modified test was carried out using a device according to the invention that was switched off (electrodes separated from the voltage source). The washing result was quantified as in test V1.

| | ΔY stain 1 | ΔY stain 2 | ΔY stain 3 | ΔY stain 4 |
|---|---|---|---|---|
| V1 | 51.3 | 59.5 | 46.7 | 64.9 |
| R1 | 44.5 | 50.0 | 40.3 | 62.5 |

It can be clearly seen that the washing performance with the device according to the invention switched on is better than in the corresponding reference experiment.

DETAILED DESCRIPTION OF THE INVENTION

Figure 1:
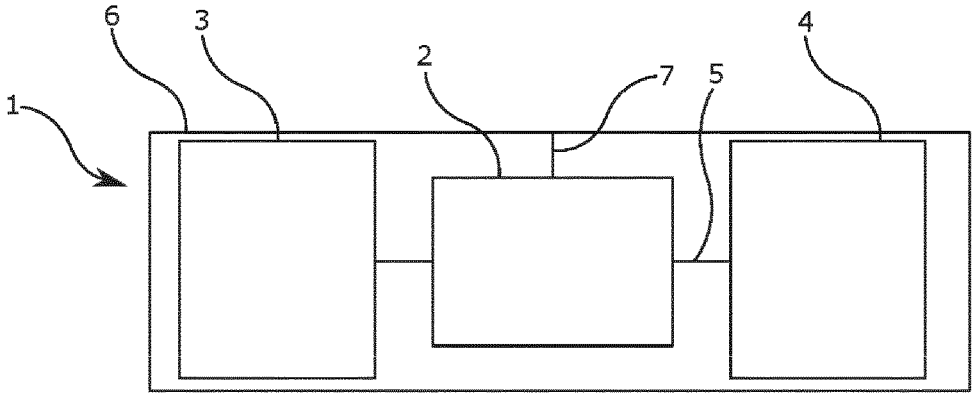
FIG. 1 is a diagram of a device according to the invention.

FIG. 1 shows a device 1 for activating a mediator species (not shown here in more detail) to form a bleach-active species by way of electrolysis, comprising a voltage source 2 and an anode 3 connected to voltage source 2 and a cathode 4 connected to voltage source 2. The anode 3 and the cathode 4 are each connected to the voltage source 2 by means of an electrical connection 5.

Furthermore, a liquid-permeable sheath 6, which electrically insulates against short circuits by direct contact, is provided, in which the anode 3—and also the cathode 4 and the voltage source 2—is enclosed. The sheath 6 is fastened by means of a fastening element 7 to a housing (not shown here in more detail) of the voltage source 2 and consists of a net which is woven from an electrically insulating textile. Alternatively, other electrically non-conductive and at the same time water-permeable and ion-permeable materials can be selected. To ensure electrical insulation by means of the sheath 6, the size of the meshes and the openings in the net and the thickness of the net are selected such that no part of the electrodes 3, 4 can protrude through the sheath 6.

Both the anode 3 and the cathode 4 are made of steel wool. Thus, the majority of their effective surfaces lies inside thereof. Inside is understood to mean the region located below a convex envelope of the electrode. In particular, forming the electrodes from steel wool also creates a plurality of channels within each electrode. This achieves a particularly compact design.

The electrodes are also elastically deformable because they are formed from steel wool. Thus, if the anode 3 is deformed, deformations of the channels and changes in their internal volumes also occur, as a result of which fluid exchange or convention can be promoted.

As indicated in the diagram, the anode 3 and the cathode 4 are arranged laterally on two opposite sides of the voltage source. Due to their elasticity in particular, the anode and the cathode thus act as a protective cushion in both lateral spatial directions. Since the two electrodes (likewise as indicated schematically) are also designed, perpendicularly to the lateral dimension, to be higher and wider than the voltage source 2, the electrodes act as a protective cushion in all spatial directions and thus prevent the voltage source from coming into contact with a plane, or thus a concave surface such as the inner wall of a washing drum.

Figure 2:
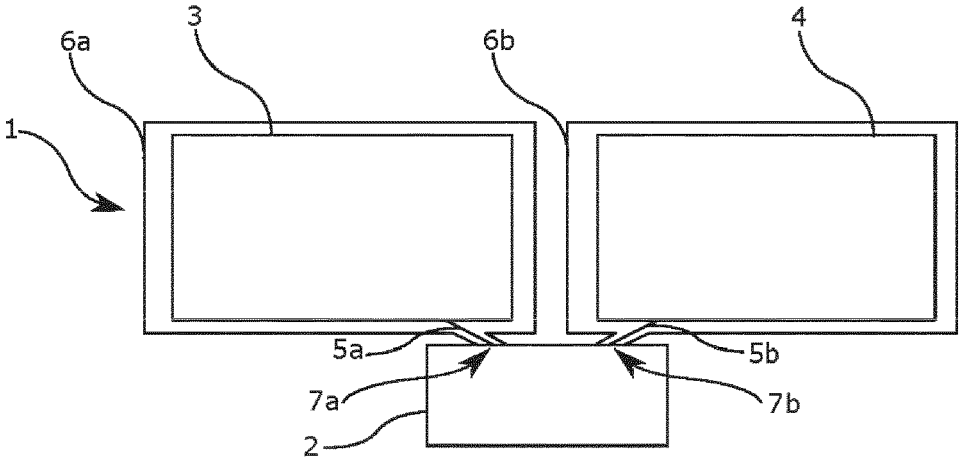
FIG. 2 is a diagram of another embodiment of a device according to the invention.

FIG. 2 shows another embodiment of the invention. This differs from the example in FIG. 1 in that the anode 3 and the cathode 4 are each enclosed by their own sheath 6*a* and 6*b*, respectively. The sheaths 6*a*, 6*b* simultaneously provide insulation of the lines 5*a*, 5*b*, in each case in the form of a hose (here indicated schematically), at the end of which a connecting element 7*a*, 7*b* is provided for the detachable mechanical and electrical connection of the anode 3 or cathode 4, respectively, to the voltage source 2. This can, for example, simplify the maintenance or the replacement of a sheath and/or the relevant electrode.

Figure 3:
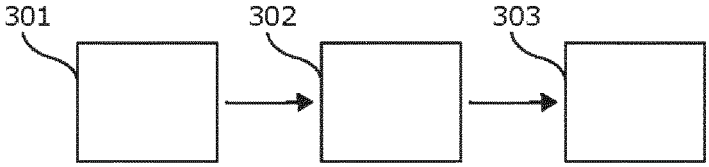
FIG. 3 is a diagram of a method according to the invention.

According to FIG. 3, in a first step 301 a device 1, for activating a mediator species by way of electrolysis, is placed in a washing drum (not shown here in more detail). In step 302 the washing liquor, i.e., a liquid which contains a mediator species, is provided in the washing drum such that the device and in particular the anode 3 come into contact with the washing liquor. The device 1 is operated in a step 303, i.e., a voltage is applied between the cathode and the anode by means of the voltage source and the mediator species is thus converted into the bleach-active species.

Figure 4:
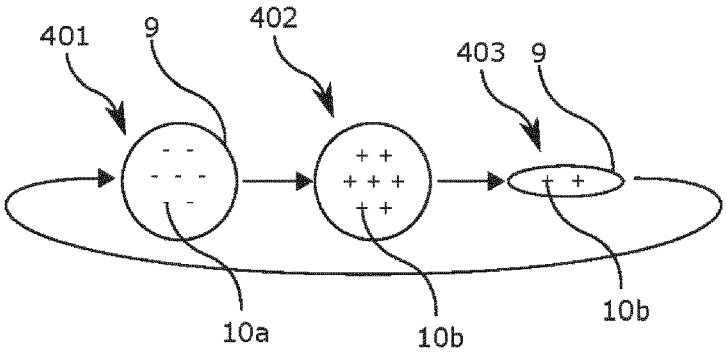
FIG. 4 is a diagram of a channel in different operating conditions.

FIG. 4 illustrates the operating principle of convection within an anode 3, in particular in the case of an elastically deformable anode 3, using the example of a schematically shown channel 9.

In a first operating condition 401, the channel 9 is filled with a liquid which contains mediator molecules 10*a* that are predominantly or substantially in reduced form. In a subsequent second operating condition 402, the mediator molecules 10*b* are oxidized, i.e., activated, due to an electrochemical reaction on the wall of the channel 9, i.e., on the surface of the anode 3. In a third operating condition 403, the anode 3, including the channel 9, is elastically compressed, for example due to an impact with the inner wall of the washing drum, such that the activated mediator molecules 10*b* are conveyed out of the channel 9—and out of the anode 3. The anode 3 is then elastically deformed back into its basic state such that the channel 9 regains its original volume and thereby absorbs liquid—which, due to the reaction with the laundry to be bleached, contains predominantly or substantially reduced mediator molecules 10*a*—thereby achieving the first operating condition 401. The non-linear movement, which is typically subject to high accelerations, of the device according to the invention in the washing drum is thus used to make the anode effectively act as a pump.

The invention is not restricted to the embodiments described above. Rather, embodiments are also included which are covered by the following claims. For example, a zip fastener can be provided to open a sheath. The voltage source can also have a generator, for example a flywheel.

LIST OF REFERENCE SIGNS

1 device
2 voltage source
3 anode
4 cathode
5 connection
6 sheath
7 connecting element
9 channel
10 mediator molecule
301-303 method step
401-403 operating condition

What is claimed is:

1. A device for activating a mediator species via electrolysis, the device comprising:

a voltage source;

an anode connected to the voltage source;

a cathode connected to the voltage source; and a liquid-permeable, electrically non-conductive sheath that encloses the entirety of the anode and the cathode, wherein the sheath is flexible; and wherein the sheath comprises a spongy intermediate layer configured to absorb a certain amount of washing liquor.

2. The device of claim 1, wherein the sheath defines at least one closable opening configured to enable removal of the anode and/or the cathode.

3. The device of claim 1, wherein the sheath also encloses the voltage source.

4. The device of claim 3, wherein the voltage source has a housing and the sheath is fastened to the housing.

5. The device of claim 1, wherein at least half of the area of the effective surface of the anode is arranged inside the anode.

6. The device of claim 1, wherein the anode has a plurality of channels.

7. The device of claim 1, wherein the anode is deformable.

8. The device of claim 1, wherein every first point on the surface of the anode is either exposed or rests against a second point on the surface of the anode, wherein each second point is movable relative to a corresponding first point.

9. The device of claim 1, wherein the anode comprises a material selected from the group consisting of steel wool, electrically conductive polymers, electrically conductive textiles, and chips.

10. The device of claim 1, wherein the voltage source is protected from contact with external planes in all spatial directions by padding.

11. The device of claim 1, wherein the voltage source comprises a generator.

12. The device of claim 1, further comprising a sensor configured to measure at least one of conductivity, pH, temperature, acceleration, or sound.

13. The device of claim 1, wherein the sheath is reversibly deformable via a force that is less than the weight of the sheath.

14. The device of claim 1, wherein the sheath defines a first compartment that separately encloses the anode and a second compartment that separately encloses the cathode.

15. A device for activating a mediator species via electrolysis, the device comprising:

a voltage source;

an anode connected to the voltage source;

a cathode connected to the voltage source; and a liquid-permeable, electrically non-conductive sheath that encloses the entirety of the anode and the cathode, wherein the sheath is flexible; and wherein the anode and the cathode are arranged laterally on opposite sides of the voltage source.

16. The device of claim 15, wherein the voltage source is protected from contact with external planes in all spatial directions by padding.

17. The device of claim 16, wherein the padding comprises the anode and the sheath.

18. The device of claim 15, wherein the sheath is in the form of a mesh-like structure.

19. The device of claim 15, wherein the anode has a plurality of channels.

20. The device of claim 15, wherein the anode is deformable.

* * * * *